United States Patent [19]

Sommer

[11] 4,090,378

[45] May 23, 1978

[54] ROUGHING MACHINE HAVING ROCKABLE SHOE ASSEMBLY SUPPORT

[75] Inventor: Gerald Sommer, Pirmasens, Germany

[73] Assignee: International Shoe Machine Corporation, Nashua, N.H.

[21] Appl. No.: 792,166

[22] Filed: Apr. 29, 1977

[30] Foreign Application Priority Data

Oct. 30, 1976 Germany ..... 2650079

[51] Int. Cl.[2] ..... C14B 1/44; A43D 0/00

[52] U.S. Cl. ..... 69/6.5; 12/1 R

[58] Field of Search ..... 12/1 R, 1 A, 17 R, 17.2, 12/77, 88, 91, 92; 69/6.5

[56] References Cited

U.S. PATENT DOCUMENTS

| | | | |
|---|---|---|---|
| 2,163,031 | 12/1964 | Kostell | 69/6.5 |
| 3,843,985 | 10/1974 | Leonhardt | 12/1 R |
| 3,975,932 | 8/1976 | Vornberger | 69/6.5 |

*Primary Examiner*—Patrick D. Lawson
*Attorney, Agent, or Firm*—Albert Gordon

[57] ABSTRACT

A roughing machine operable to rough the margin of an upper of a shoe assembly that comprises a last having an insole located on its bottom and the upper mounted thereon with the upper margin lying against and being secured to the bottom of the insole. The shoe assembly is supported bottom-up on a shoe assembly support and the shoe assembly support is so moved as to move succeeding portions of the upper margin past a roughing tool. During this movement of the shoe assembly support, the shoe assembly support is caused to rock to thereby rock the shoe assembly.

7 Claims, 17 Drawing Figures

202
130
208
266
204
206
94
264
256
12A
12A
216
210

264

210
130
202
266
206
94

264
202
130
210
204
206
94
12C
12C
268
220

130
202
210
204
206
94
264

ROUGHING MACHINE HAVING ROCKABLE SHOE ASSEMBLY SUPPORT

BACKGROUND AND SUMMARY OF THE INVENTION

U.S. Pat. No. 3,843,985 and U.S. Patent Application Ser. No. 694,005 filed June 8, 1976, now U.S. Pat. No. 4,020,660, each discloses a machine for roughing the margin of an upper of a shoe assembly, the shoe assembly comprising a last having an insole located on its bottom and the upper mounted thereon with the upper margin lying against and being secured to the bottom of the insole. The machine includes: a shoe assembly support for supporting the shoe assembly bottom up; a margin sensor engageable with the upper margin; a side sensor, located below the margin sensor, engageable with the side of the shoe assembly; a roughing tool located inwardly of the side sensor and proximate to the margin sensor and engageable with the upper margin to rough the upper margin; means mounting both sensors and the roughing tool for unitary heightwise movement; and means mounting both sensors and the roughing tool for unitary inward-outward movement (movement towards and away from the shoe assembly) in a particular direction. The machine incorporates means for so moving the support as to move succeeding upper margin portions past the margin sensor and as to move corresponding succeeding side portions of the shoe assembly past the side sensor to thereby move the upper margin portions past the roughing tool. The machine also incorporates means enabling the margin sensor to move heightwise and follow the contour of the upper margin portions to thereby enable the roughing tool to move heightwise accordingly and means enabling the side sensor to move inwardly-outwardly in said particular direction and follow the contour of the shoe assembly side portions to thereby enable the roughing tool to move inwardly-outwardly accordingly.

It is desirable, in order for the roughing tool to engage all portions of the upper margin uniform distances inwardly of the outer peripheries of the margin portions, that a line extending from the area of engagement of the roughing tool with each margin portion along the surface of the margin portion to the outer periphery of the margin portion towards the area of engagement of the side sensor with the corresponding portion of the side of the shoe assembly be substantially parallel to said particular direction of unitary inward-outward movement of the sensors and the roughing tool. If a margin portion is so contoured that this line is sloped downwardly with respect to said particular direction as it extends outwardly from the area of engagement of the roughing tool with the upper margin towards the outer periphery of the margin portion, the roughing tool will, undesirably, engage the margin portion further inwardly of its outer periphery than is the case when said line is parallel to said particular direction.

The principal object of this invention is to provide an improved arrangement for ensuring that each margin portion is so positioned as it passes the sensors and the roughing tool that said line is substantially parallel to said particular direction regardless of any changes in the planes in which succeeding margin portions lie. This object is achieved by providing: means mounting the support for rocking movement between a first position and a second position; and means, effective during the support movement, for rocking the support from its first position to its second position.

Dealing with a first species of the invention, the heel and forepart portions of the shoe assembly bottom lie in intersecting planes. In each of the above referred to prior art machines, the means for so moving the support as to move the margin portions past the roughing tool comprises: means for so rotating the support 180° about a vertical axis in a particular rotational direction as to rotate a first end of the upper margin, disclosed as the heel end, past the roughing tool; means for thereafter so horizontally moving the support linearly as to move a side of the upper margin past the roughing tool; and means for thereafter so rotating the support 180° about said vertical axis in the same rotational direction as to rotate the second end, disclosed as the toe end, of the upper margin past the roughing tool. The particular direction of inward-outward movement of the sensors and the roughing tool is substantially horizontal. The shoe assembly is so supported that the first end of the shoe assembly bottom lies in a substantially horizontal plane during its rotation so that the desired relationship between said line along each margin portion and said particular direction is maintained during this rotation. However, in the prior art machine the shoe assembly is so supported that the second end lies in a plane that is inclined upwardly in a direction extending from the second end (the toe end) towards the first end (the heel end). Therefore, during the rotation of the second end of the shoe assembly the desired relationship between said line and said direction is not maintained in the prior art machine. In order to overcome this deficiency and in accordance with the first species of the invention, the prior art machine is improved by mounting the support for rocking movement about a horizontal axis that is transverse to the direction of linear movement of the support and by rocking the support from its first position to its second position by triggering means actuable pursuant to the linear movement of the support to thereby cause the second end of the shoe assembly bottom to lie in a substantially horizontal plane during the second 180° rotation of the support.

Dealing with a second species of the invention, certain shoe assembly bottoms are arched upwardly convex in planes that are transverse to the longitudinal heel-toe axis of the shoe assembly so that the upper margin tapers downwardly to a great extent towards the side of the shoe assembly, this condition existing particularly in the forepart area of the shoe assembly bottom. In the above referred to prior art machines, the means for so moving the support as to move the upper margin portions past the roughing tool comprises: means for so horizontally moving the support linearly in a first direction as to move a first side of the upper margin past the roughing tool; means for thereafter so rotating the support 180° about a vertical axis as to rotate an end of the upper margin past the roughing tool; and means for thereafter so horizontally moving the support linearly in a second direction opposite to said first direction as to move the second side of the upper margin past the roughing tool. As aforesaid, the direction of inward-outward movement of the sensors and the roughing tool in each prior art machine is substantially horizontal. When the prior art machine operates on a shoe assembly having the upwardly convex sections and the shoe assembly is so supported that said lines along the margin portions on one side of the shoe assembly are substantially parallel to said particular direction, the lines along the margin portions on the other side of the shoe assembly will not be parallel to said particular direction. In order to overcome this deficiency and in accordance with the second species of the invention, the prior art machine has the improvements wherein: the means mounting the support is so constructed as to enable the support to be rocked through an upwardly concave arc whose center of curvature lies on a horizontal axis that is parallel to the directions of linear movements of the support; the first position of the support is such that the support is tilted about this horizontal axis on one side of the vertical axis of the support; the second position of the support is such that the support is tilted about this horizontal axis on the other side of the vertical axis of the support; and the support is rocked from its first position to its second position by triggering means that are actuable pursuant to the support rotation.

DESCRIPTION OF THE PREFERRED EMBODIMENT

Figure 1:
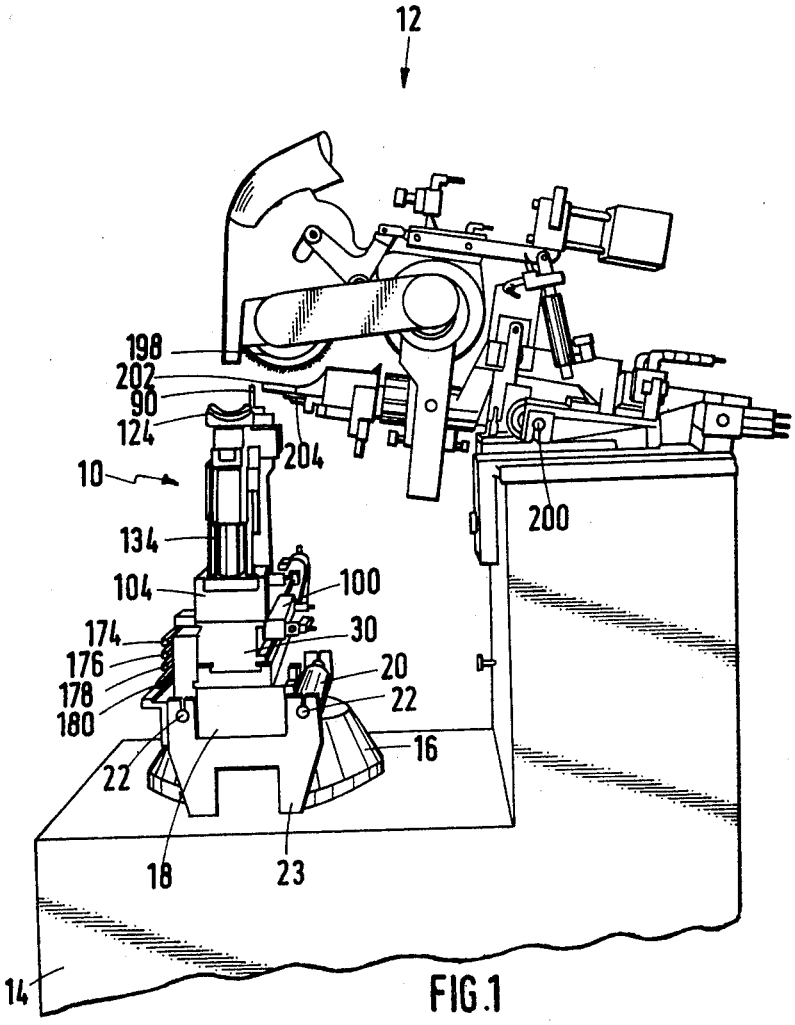
FIGS. 1 and 2 are side views of the machine taken from opposite sides of the machine.
Figure 2:
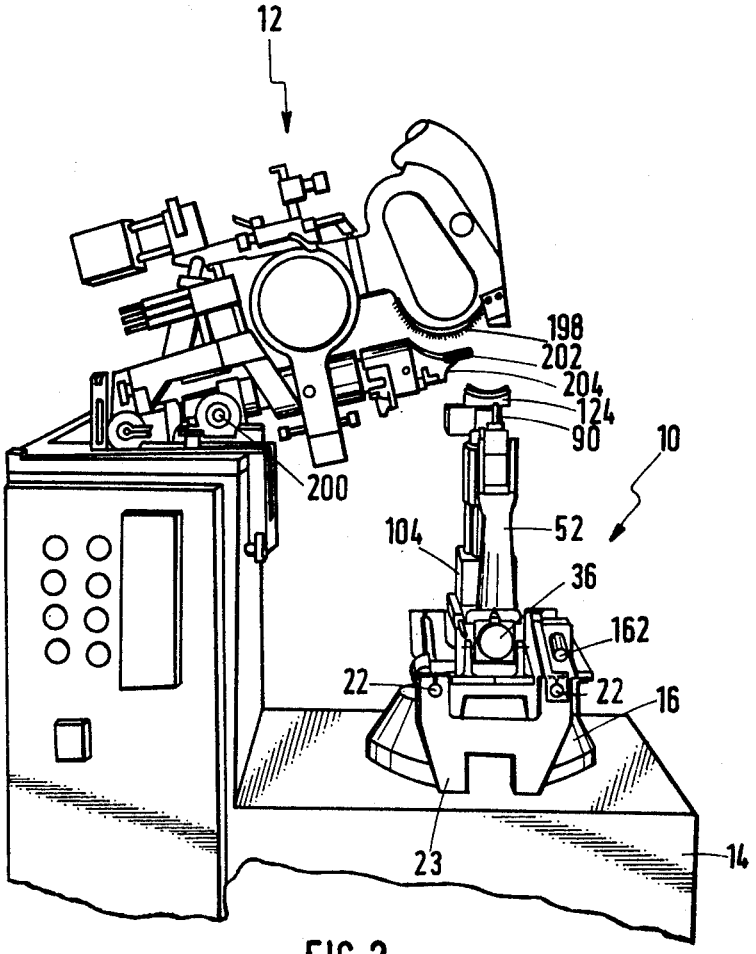

The operator is intended to stand to the left of the machine as seen in FIG. 1 and to the right of the machine as seen in FIG. 2. Directions extending toward the operator will be designated as "forward" and directions extending away from the operator will be designated as "rearward". The front of the machine is closest to the operator and the back of the machine is furthermost from the operator.

The machine, as shown in FIGS. 1 and 2, includes a shoe assembly mount section 10 and a tool section 12 located rearwardly of the section 10.

The shoe assembly mount section 10 includes a stationary base 14 having a turntable 16 mounted thereto for rotation in a horizontal plane about a fixed vertical axis. A slide 18 (FIGS. 1–5) is slidably guided in the turntable 16 for reciprocal motion in a horizontal plane between two end positions on the turntable by means of two bushings 20 on the slide 18 that are slidably guided on rods 22. The rods 22 extend across the top of the turntable 16 and are affixed to the turntable 16 by means of holders 23 supporting the ends of the rods 22.

Two spaced parallel guide elements 24 are fastened to the slide 18. Each guide element 24 mounts an arcuate track 26 which forms a segment of a circle. A base 30 is slidably guided by means of arcuate guides 28 attached thereto in the arcuate tracks 26. Two spaced support components 40, screwed onto the slide 18, have pins 38 thereon which pivotally mount a double-acting pneumatic motor 36 for swinging movement about a transverse axis. The piston rod 34 of the motor 36 is connected by means of a bracket 32 to the base 30. The motor 36 may be operated by means of compressed air passing thereto through ports 42, 44 to move the base 30 to and fro in the arcuate tracks 26 to thereby impart a swinging movement to the base 30 and the parts carried thereby. A stop 46 screwed onto the base 30 coacts with a threaded spindle 48 which is screwed into an angle plate 50 fastened to the slide 18 to limit the displacement of the movement of the base 30 in the tracks 26.

Figure 5:
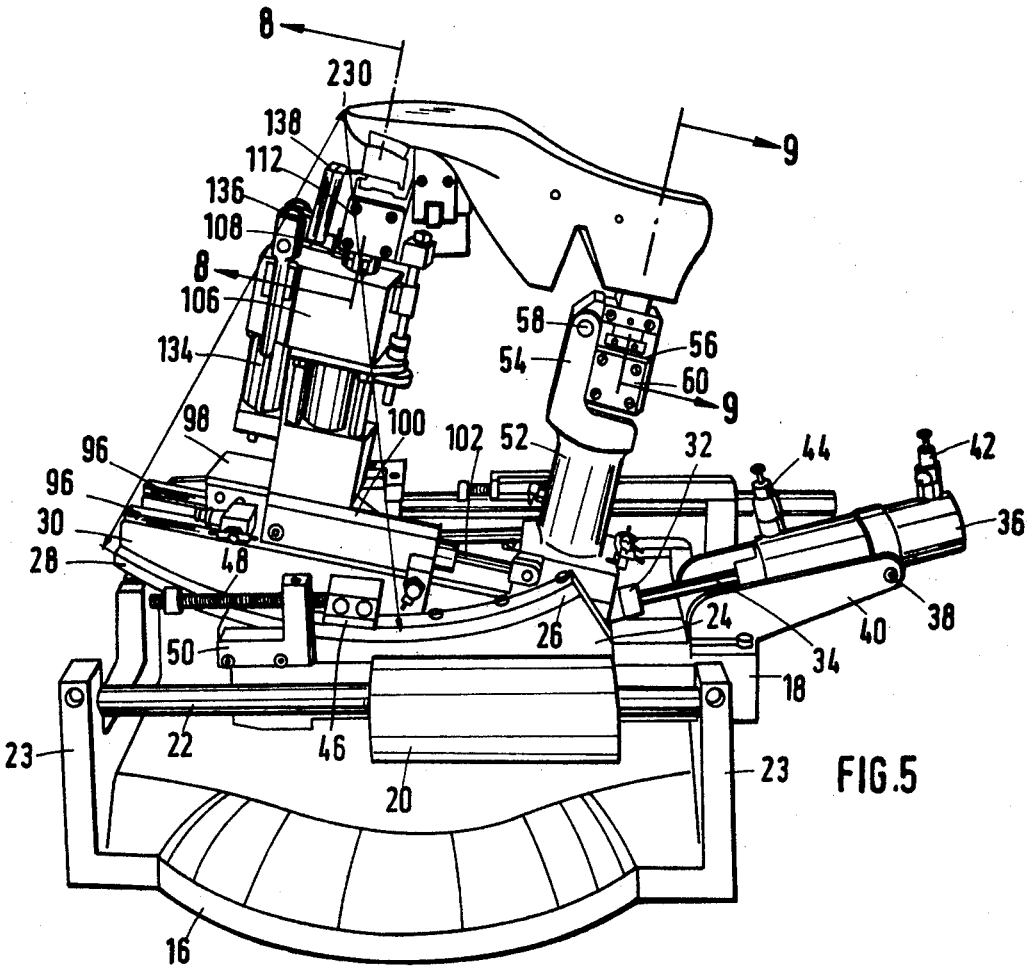
Figure 9:
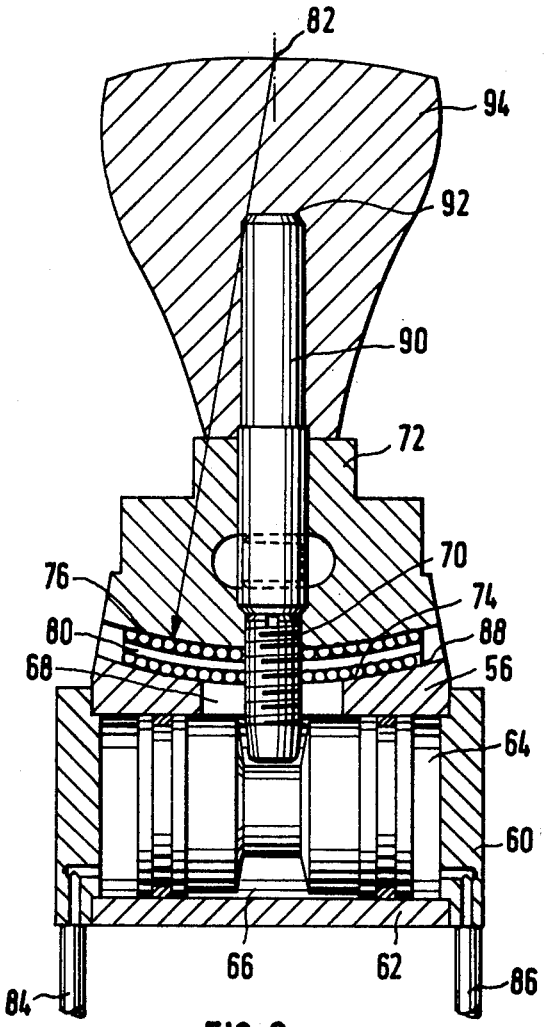

A post 52 is fastened to the base 30 and extends upwardly thereof. An upwardly extending bracket 54 is carried on the upper end of the post 52 and a base 56 (FIGS. 5 and 9) is swingably mounted, by means of a pivot pin 58, to the bracket 54. The base 56 mounts a double-acting pneumatic motor 60 on its bottom. A limit-stop arrangement limits the extent of clockwise movement, as seen in FIG. 5, of the base 56, together with the motor 60, about the pivot pin 58 while permitting free counterclockwise movement of the base 56 and the motor 60 from the FIG. 5 position. The motor 60 comprises a double flanged piston 64 that is slidably guided in a cylinder 62. The piston 64 has an annular groove 66 in its middle. An actuating pin 70, which is captured in a bore of a bearing element 72, projects into and projects upwardly of the groove 66. The base 56 is so shaped as to have a circularly curved guide surface 74 which corresponds to a similarly curved guide surface 76 of the bearing element 72. A needle bearing 80 is so arranged between the two guide surfaces 74 and 76 that the bearing element 72 can be swung transversely about the longitudinal axis designated by number 82 in FIG. 9. This swinging movement is produced by the motor 60 whose piston 64 can be supplied with pressurized air via ports 84 and 86. The bearing element 72 is laterally guided alongside the piston 64 on the base 56 by means of guide rails 88 that are appropriately bent in the form of a circular arc.

The bearing element 72 carries a last pin 90 that is arranged coaxially to and projects upwardly of the actuating pin 70, the last pin 90 fitting into a corresponding last pin hole 92 of a last 94 mounted on the bearing element 72 whereby the bearing element 72 and the last pin 90 form a supporting element for the last 94. The last 94 forms a part of a shoe assembly described below.

Rails 96 on the base 30 slidably mount a bar 98 to the top of the base 30 for movement towards and away from the post 52. A pneumatic motor 100 is attached to the bar 98 and the piston rod 102 of the motor 100 has its end attached to the post 52, the motor 100 thus enabling the bar 98 to be moved towards and away from the post 52.

The bar 98 carries a foot 104 which mounts a pneumatic motor 106. The upwardly projecting piston rod 108 of the motor 106 is connected with the cylinder 110 of a double-acting pneumatic motor 112.

Figure 8:
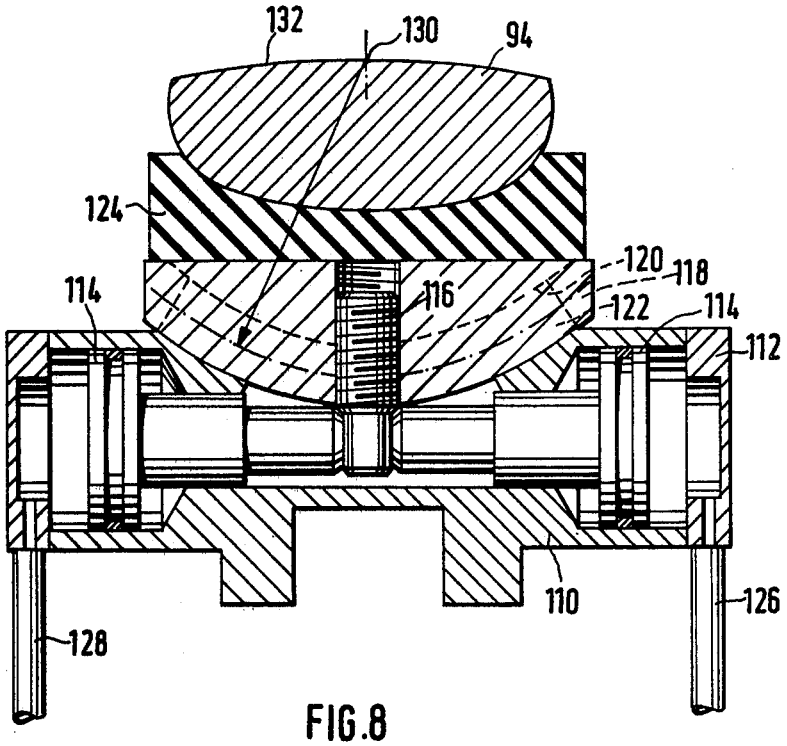
FIGS. 8 and 9 are respectively sections taken along the lines 8—8 and 9—9 of FIG. 5.

As can be seen in FIGS. 5 and 8, two pistons 114 are slidably mounted in the cylinder 110 of the motor 112. The pistons 114 are engageable with the opposite sides of an actuating trunnion 116 which projects through a slot of the wall of the cylinder 110. The actuating trunnion 116 is rigidly connected with a circular segment 118. The circular segment 118 is slidably guided, via a T-shaped groove 120, in a correspondingly shaped guided element 122 which is affixed to the cylinder 110. The circular segment 118 has a level top on which is mounted a rubber supporting toe pad 124 which supports the forepart of the shoe assembly comprised of the last 94 in the manner shown in FIG. 8.

When the two pistons 114 of the motor 112 are alternately supplied with pressurized air via the ports 126 and 128 leading into them, the actuating trunnion 116 is moved to and fro. This results in the circular segment 118 being swung in the guideway formed by the groove 120 about an axis designated by number 130 so that the shoe assembly is laterally tilted or rocked about this axis which lies in the area of the bottom 132 of the shoe assembly.

A pneumatic motor 134 is mounted on the front of the foot 104. The upwardly directed piston rod 136 of the motor 134 is connected to a toe stop 138 which, when the motor 134 is actuated, is raised to such an extent as to be in registry with the toe end extremity of the shoe assembly.

Two mounts 140, 142 (FIGS. 3 and 6) are affixed to the slide 18 by being screwed onto one of the guide elements 24, the mounts 140, 142 being located laterally of the base 30. The ends of two spaced and parallel guide rods 146 and 148 that are located one above the other and are arranged parallel to the direction of movement of the slide 18 on the turntable 16 are inserted into and extend between the mounts 140, 142. A plate-like guide element 150 is slidably guided longitudinally along the guide rods 146, 148. The guide element 150 has a projecting nose 152 on its top that is in intersecting relationship with a laterally projecting follower 154 that is screwed onto the foot 104. The nose 152 and the follower 154 are so arranged that the follower 154 can engage and push the nose 152 during movement of the foot 104 towards the post 52 and the nose 152 can engage and push the follower 154 during movement of the guide element 150 away from the post 52. An end of a toothed guide bar 156 is rigidly connected to the guide element 150 and extends parallel to the guide rods 146 and 148, the guide bar 156 being longitudinally guided and slidable in a housing 158 that is screwed to the slide 18. The end of the guide bar 156 remote from the guide element 150 is coupled to the piston 160 of a pneumatic motor 162, the motor 162 being mounted on the housing 158. A locking trunnion 164 is longitudinally guided in the housing 158 in a direction that is crosswise to the longitudinal axis of the guide bar 156. The trunnion 164 has teeth 166 at its top that correspond to the teeth on the guide bar 156 and is connected at its bottom to the piston of a pneumatic motor 172, said piston being yieldably urged downward by a return spring 170. When the motor 172 is actuated, the teeth 166 of the locking trunnion 164 are caused to mesh with the teeth of the guide bar 156 so that the guide bar 156 is locked in relation to the housing 158, this resulting in the guide element 150 also being locked with respect to the slide 18 in the position determined by the position of meshing of the teeth 166 with the teeth on the guide bar 156.

Figure 6:
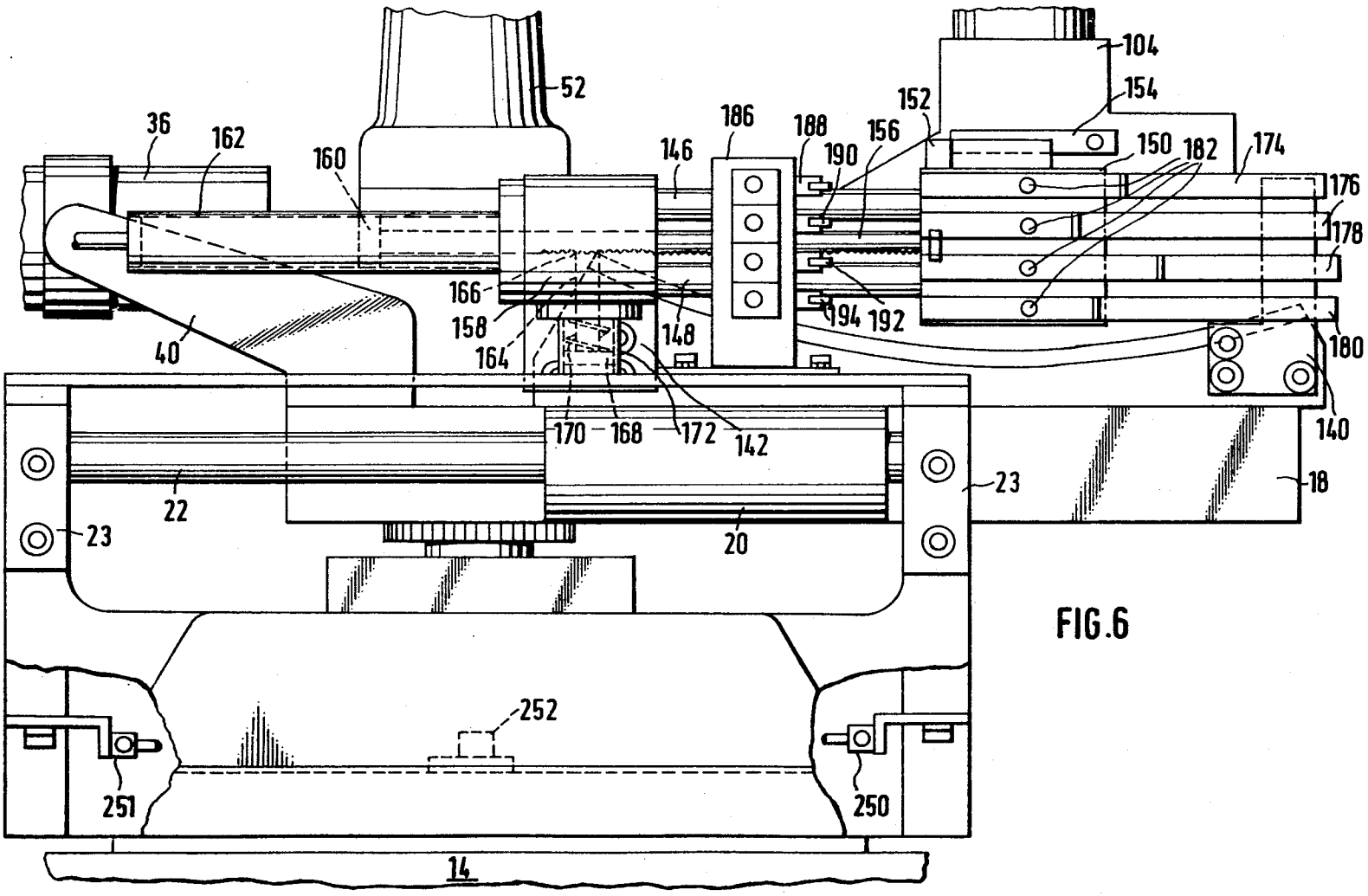
FIG. 6 is a side elevation, to an enlarged scale, of a portion of the mount section.
Figure 7:
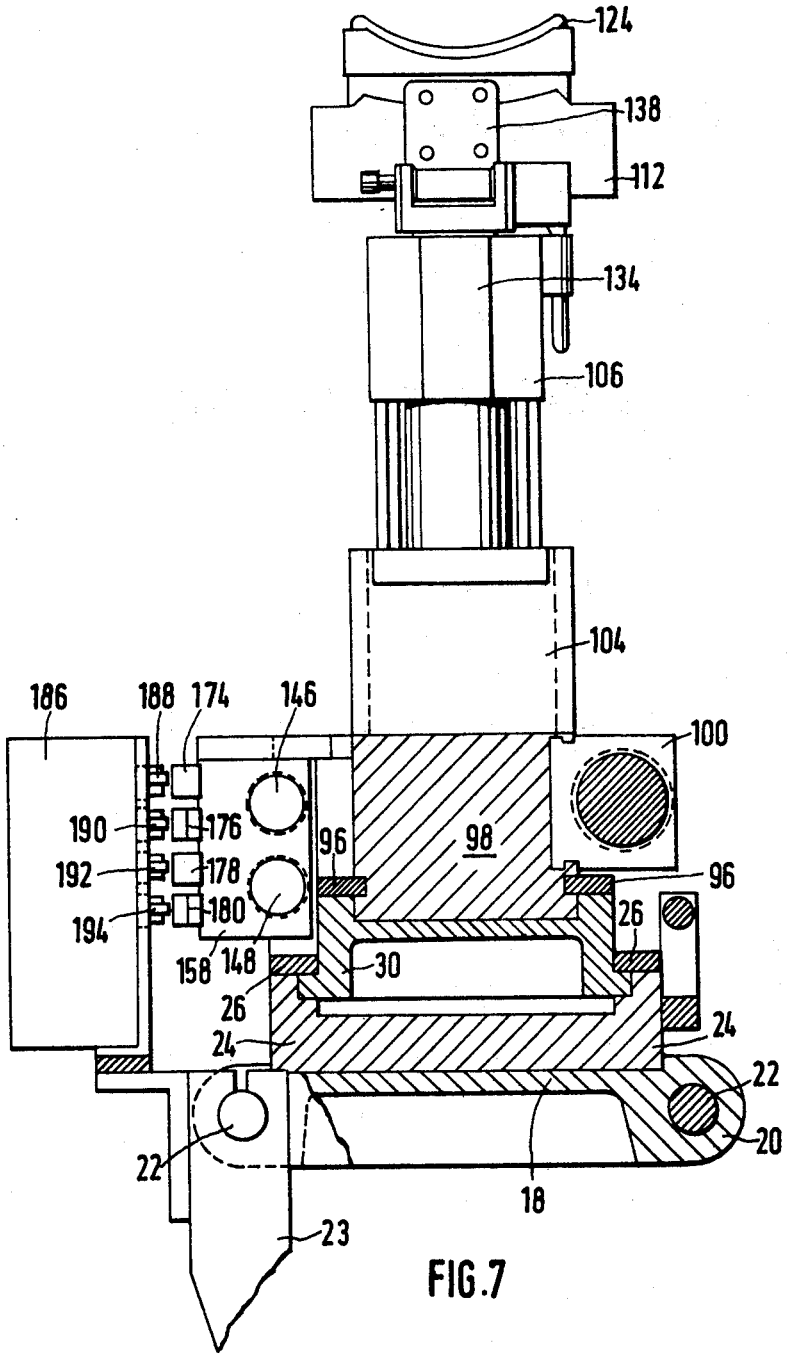
FIG. 7 is a transverse partially cross-sectional view of a portion of the mount section.

Four cams 174, 176, 178, 180, which act as actuating members, are spacedly locked to the guide element 150 in desired positions by adjusting screws 182 shown in FIG. 6.

A holder 184 screwed to the turntable 16 mounts a valve assembly 186. The valve assembly 186 is located laterally of the path of movement of the guide element 150. The valve assembly 186 comprises four valves, which act as control members, having valve actuating members 188, 190, 192 and 194. The valve actuating members 188, 190, 192 and 194 are respectively in alignment with the cams 174, 176, 178 and 180.

The tool section 12 of the machine includes a rotating wire brush 198 (FIGS. 2 and 10) which forms a roughing tool. The brush 198 is mounted for heightwise movement about the horizontal axis of two bearing trunnions 200. A pair of fork tines 202 are mounted on opposite sides of the brush 198 and a feeler roll 204 is located below the fork tines 202. The fork tines 202 act as a margin sensor and the feeler roll 204 acts as a shoe assembly side sensor.

Figure 3:
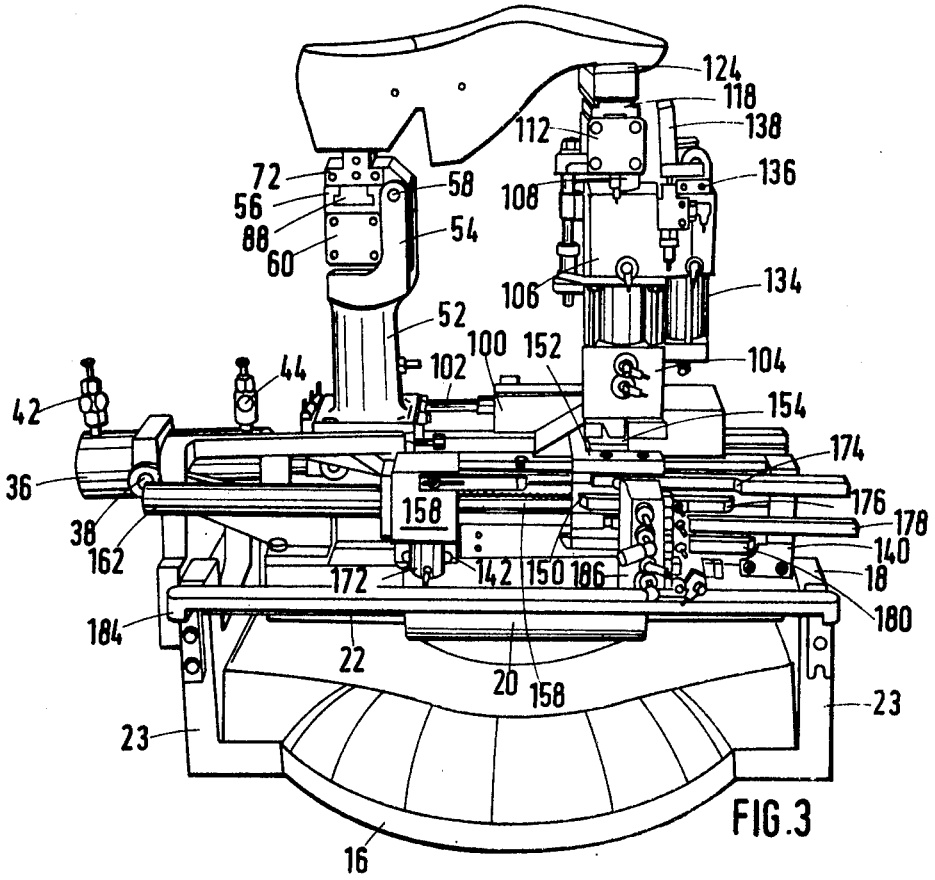
FIG. 3 is a perspective view of a mount section of the machine showing the shoe assembly mounted thereto.

In the idle condition of the machine: the slide 18 is at one of its end positions on the turntable 16; the piston rod 34 is retracted into the motor 36 to thereby so position the base 30 in the tracks 26 that, as shown in FIG. 3, the base 30 is in a prone position; the piston rod 102 is projected out of the motor 100 to place the foot 104 and the parts carried thereby, including the toe pad 124 and the toe stop 138, relatively remote from the post 52 and the last pin 90; the last pin 90 is in substantial alignment with the axis of rotation of the turntable 16 and is in substantial forward-rearward alignment with the brush 198; the brush 198, the margin sensor 202, and the side sensor 204 are swung upwardly about the axis of the trunnions 200; the piston rod 108 is retracted into the motor 106 to place the toe pad 124 in a lower position; the piston rod 136 is projected out of the motor 134 to place the toe stop 138 in its raised position; the piston 160 is projected out of the motor 162 by pressurized air to thereby yieldably urge the guide bar 156 and the guide element 150 rightwardly (FIG. 6) to a position wherein the nose 152 engages the follower 154; there is no pressurized air in the motor 172 so that the spring 170 is urging the trunnion 164 downwardly with the teeth 166 disengaged from the teeth of the guide bar 156; and the cams 174, 176, 178 and 180 are respectively spaced from and disengaged from the valve actuating members 188, 190, 192 and 194.

FIGS. 12 and 12A–12D show the shoe assembly that comprises the last 94 having an upper 206 mounted thereon and an insole 208 located on its bottom. The upper 206 has been lasted so that the upper margin 210 lies against and is secured to the insole 208 and extends inwardly of the periphery of the insole and the last bottom.

The shoe assembly is mounted by the operator bottom-up on the last pin 90 with the last pin entering the last pin hole 92 in such a manner that the toe end of the shoe assembly faces the foot 104 with the heel portion of the shoe assembly bottom lying in a substantially horizontal plane. The operator, in the manner disclosed in U.S. Patent Application Ser. No. 694,005, now actuates the motor 100 so as to retract its piston rod 102 and thus move the foot 104 together with the toe pad 124 and the toe stop 138 towards the post 52 under the yieldable force of pressurized air until the toe stop 138 engages the toe end of the shoe assembly. Concurrently with this actuation of the motor 100, the pressurized air is vented from the motor 162. The movement of the foot 104 towards the post 52 causes the follower 154 to push the nose 152 towards the post 52 and thereby move the guide element 150, the cams 174, 176, 178 and 180, and the guide bar 156 leftwardly (FIG. 6) against the force of the pressurized air of the motor 162. When the toe stop 138 has engaged the toe end of the shoe assembly, the motor 172 is actuated to raise the trunnion 164 and thus cause the teeth 166 to mesh with the teeth on the guide bar 156 so as to lock the foot 104 in the position it had assumed on the base 30 when the toe stop 138 engaged the toe end of the shoe assembly. This is followed by an actuation of the motor 106 to raise the toe pad 124 into engagement with the vamp of the shoe assembly and thereby swing the base 56 clockwise (FIG. 5) about the pivot pin 58 to the extent permitted by the aforementioned limit-stop arrangement so as to lock the shoe assembly to the post 52 and the foot 104 of the slide 18 for the below described roughing operation and an actuation of the motor 134 to lower the toe stop 138 out of engagement with the shoe assembly so that it will not interfere with the roughing operation.

In the manner disclosed in U.S. PAT. No. 3,975,932, after the shoe assembly has been locked to the slide 18, the margin sensor 202, the roughing tool 198 and the side sensor 204 are lowered about the axis of the trunnions 200 until the margin sensor 202 engages the upper margin 210 in one of the breast line regions (FIG. 12A), the shoe assembly being so located that the margin sensor 202 will intersect its bottom during its descent and the side sensor 206 will be located outwardly of the shoe assembly when the margin sensor engages the shoe assembly.

Figure 10:
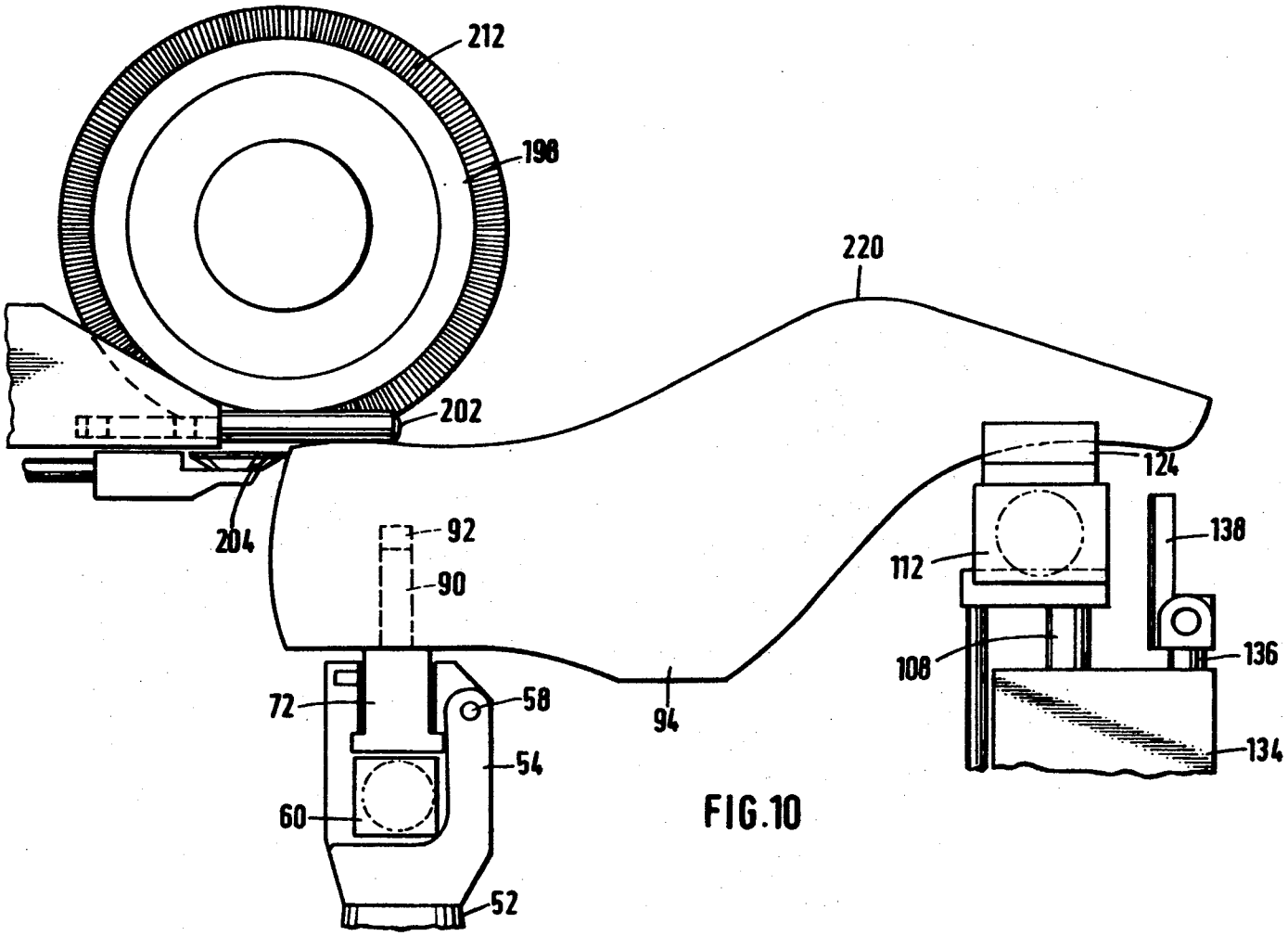
FIG. 10 is a representation of the shoe assembly as it is supported in the machine while its upper margin is being roughed.

As explained in greater detail in U.S. PAT. No. 3,975,932, in response to the engagement of the margin sensor 202 with the upper margin 210, the side sensor 204 is moved forwardly into engagement with the side of the shoe assembly after which the roughing tool 198 is swung downwardly until radially projecting bristles 212 on the roughing brush 198 engage the upper margin 210 between the fork tines of the upper sensor 202, as indicated in FIG. 10.

Now, by means of the mechanism disclosed in U.S. Patent Application Ser. No. 694,005, the turntable 16 is unlocked and is rotated 180° about its axis of rotation about a center that is substantially in alignment with the last pin 90 and that lies approximately at the center of curvature, indicated by number 216 in FIG. 12, of the heel portion of the shoe assembly. During this 180° rotational movement of the turntable 16, the heel portion of the upper margin 210 is moved past the rotating brush 198 and the brush bristles 212 abrade or rough the upper margin.

At this time, as described in U.S. Pat. No. 3,843,985 and in U.S. Patent Application Ser. No. 694,005, the brush 198, the margin sensor 202 and the side sensor 204 are mounted for unitary, substantially vertical heightwise movement and substantially horizontal inward-outward movement and for tilting movement about the inward-outward axis of the margin sensor 202. During the movement of the heel portion of the upper margin 210 past the rotating brush 198, as well as the movements of the other portions of the upper margin past the rotating brush as described below, the brush must move upwardly and downwardly in accordance with the elevation of the portion of the upper margin being roughed and must move forwardly and rearwardly so as to be positioned the desired distance inwardly of the outer periphery of the upper margin being roughed. In addition, the central plane of the brush 198, shown by number 372 in U.S. Pat. No. 3,843,985, should be tilted during the movement of the portions of the upper margin being roughed past the brush 198 so as to be at right angles to the plane of the portion of the upper margin 210 being roughed. The upward-downward movements are accomplished pursuant to upward-downward movements of the margin sensor 202 as the upper margin 210 moves past the margin sensor, these upward-downward movements being substantially vertical. The forward-rearward movements are accomplished pursuant to inward-outward movements of the side sensor 204 as the side of the shoe assembly moves past the side sensor, these inward-outward movements being substantially horizontal. The tilting movements are accomplished pursuant to tilting of the margin sensor 202 as the upper margin moves past the margin sensor 202. The means for accomplishing all these movements are disclosed in U.S. Pat. No. 3,843,985 and in U.S. Patent Application Ser. No. 694,005.

After the turntable 16 has rotated 180° to enable the heel portion of the upper margin 210 from one breast line portion to the other breast line portion to be roughed by the brush 198, the turntable 16, by mechanism shown in U.S. Patent Application Ser. No. 694,005, is caused to cease its rotation and to be locked against rotation. This is followed by a first linear horizontal movement of the slide 18 with respect to the stationary turntable 16 so that the brush 198 engages a first side portion of the upper margin 210 as the shoe assembly moves in a heel-to-toe direction past the brush 210 to thereby enable the brush to rough the first side portion of the upper margin.

Figure 11:
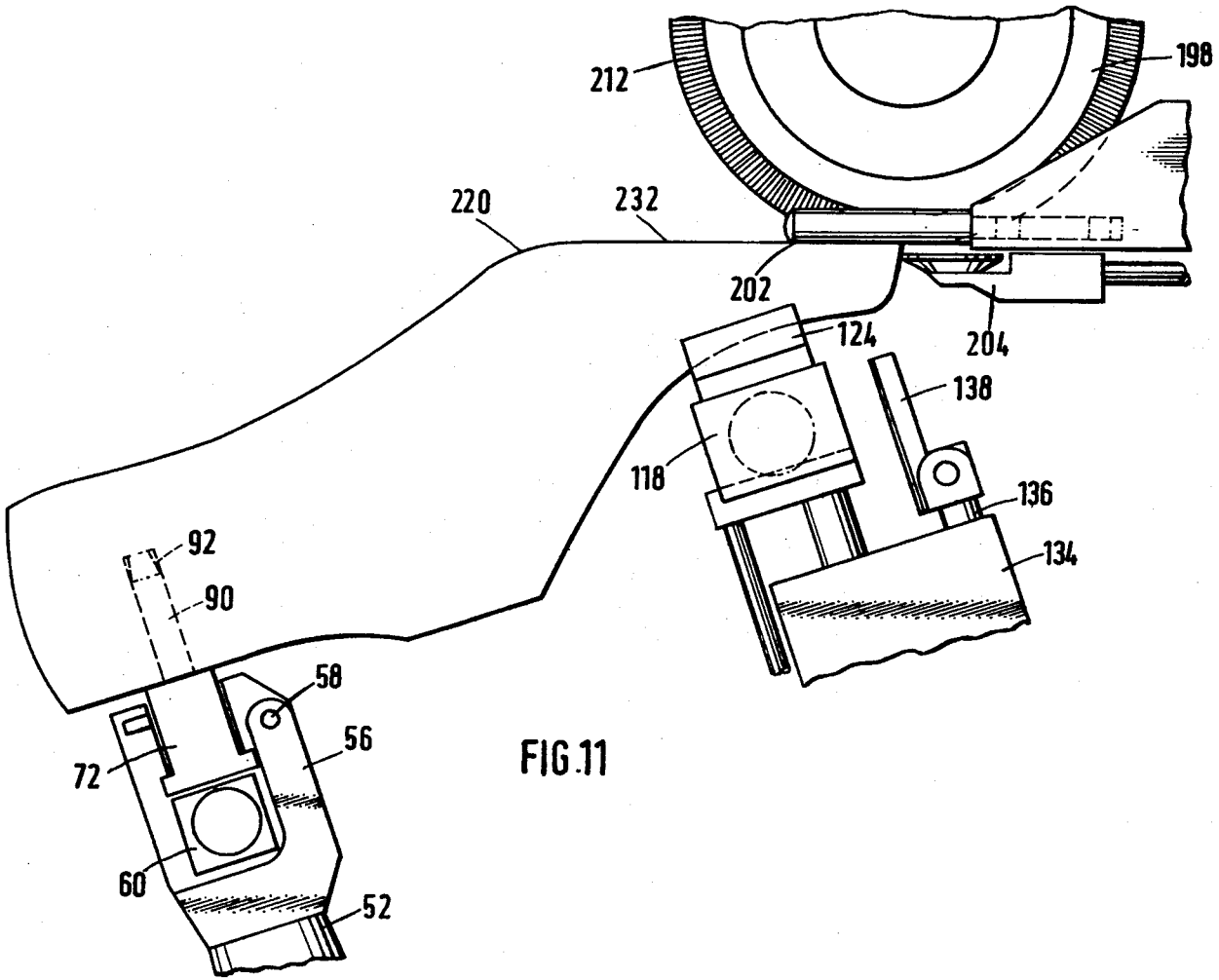
FIG. 11 is a view similar to FIG. 10 showing the shoe assembly rocked to its second position in accordance with the first species of the invention.
Figure 13:
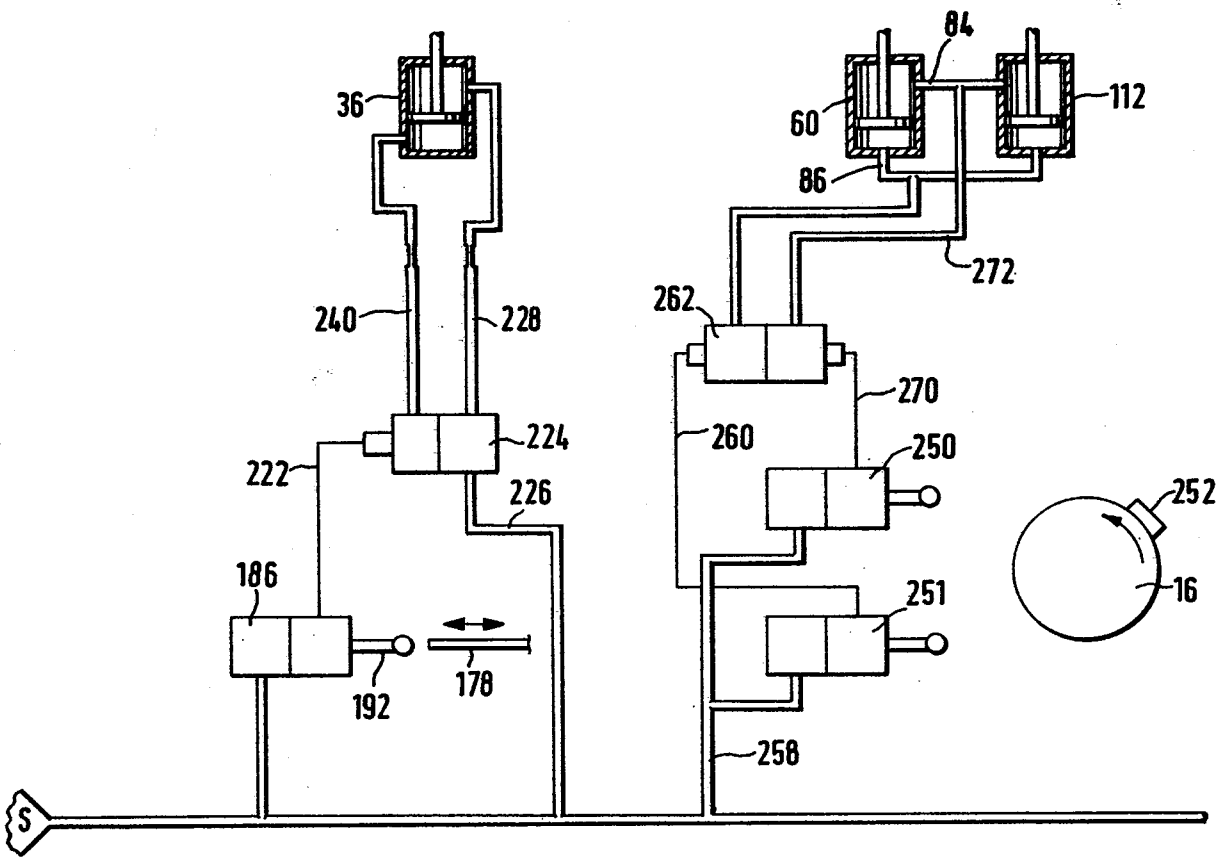
FIG. 13 is a schematic representation of part of the machine control circuit.

When the brush 198, during the linear heel-to-toe movement of the shoe assembly past the brush, reaches the vicinity of the ball break area 220 (FIG. 10) of said first side portion of the upper margin 210, the actuating cam 178, which moves linearly with the slide 18, moves past and shifts the valve actuating member 192. Referring to FIG. 13, the shifting of the valve actuating member 192 enables pressurized air to pass from a source S through the valve assembly 186 and a pilot line 222 to a valve 224 to shift the valve 224. The motor 36 is retained in its idle condition by pressurized air passing from the source S through a line 226, the valve 224, and a line 228 to the rod end of the motor 36. The shifting of the valve 224 enables pressurized air to pass from the valve 224 through a line 240 to the head end of the motor 36 to thereby cause the motor 36 to project its piston rod 34 to thereby shift the base 30 arcuately from its prone position to an inclined position along the tracks 26 about the horizontal axis 230 of the center of curvature of the tracks 26 which lies in the vicinity of the toe end of the shoe assembly and which extends transversely to the heel-toe lengthwise dimension of the shoe assembly. This shifting of the base 30 causes the shoe assembly bottom to rock downwardly about the axis 230 to the FIG. 11 position wherein the forepart portion 232 of the shoe assembly bottom substantially lies in a horizontal plane. The continued heel-to-toe linear movement of the shoe assembly causes the forepart portion of the first side portion of the upper margin 210 to move past and be roughed by the brush 198 while the forepart portion 232 substantially lies in a horizontal plane until the center of curvature of the toe portion of the shoe assembly bottom is in approximate registry with the axis of rotation of the turntable 16 at which time the cam 174 engages and shifts the valve actuator 188. The shifting of the valve actuator 188, by means shown in U.S. Patent Application Ser. No. 694,005, causes the turntable 16 to be unlocked for rotation, while the slide 18 is stationary, and cause a second 180° rotation to be imparted to the turntable in the same direction as the first 180° rotation so that the toe portion of the upper margin 210 is swung past the brush 198 and is roughed.

After completion of the second 180° rotation of the turntable 16, the turntable is caused to cease its rotation and to be locked against rotation by mechanism shown in U.S. Patent Application Ser. No. 694,005. This is followed by a second linear horizontal movement of the slide 18 with respect to the stationary turntable in a direction that is opposite to the first linear movement to bring the slide 18 back to its idle end position in the turntable 16. Pursuant to the second linear movement of the slide 18, the shoe assembly moves past the brush 198 so that the brush engages the second side portion of the upper margin 210 as the shoe assembly moves in a toe-to-heel direction past the brush 198 and the brush 198 thus roughs the second side portion of the upper margin 210.

During the second linear movement of the slide 18, at about the time that the ball break area 220 on the second side portion of the upper margin 210 passes the brush 198, the actuating cam 178 becomes disengaged from the valve actuating member 192 to thereby enable the valve 186 to return to its idle condition and cut off the pressurized air flowing to the valve 224 through the pilot line 222. The valve 224 therefore shifts back to its idle condition to enable pressurized air to again flow to the rod end of the motor 36 through the line 228 to cause the motor 36 to retract its piston rod 34 to thereby swing the base 30 along the tracks 26 and return the base 30 to its original prone position. As a result, by the time the heel portion of the upper margin 210 is engaged by the brush 198 during the second linear movement of the slide 18, said heel portion again lies in a substantially horizontal plane.

Upon termination of the second linear movement of the slide 18, the breast line portion of the upper margin 210 originally engaged by the brush 198 is again in engagement with the brush so that the roughing of the entire upper margin is completed, the machine parts are returned to their idle positions, and the machine cycle is completed. The shoe assembly, with the roughed upper margin, is now removed from the machine.

As indicated in FIGS. 12A–12D, ideally a line extending from the area of engagement of the brush 198 with a portion of the upper margin 210 along the surface of the margin portion to the outer periphery of the margin portion and towards the area of engagement of the side sensor 204 with the corresponding portion of the side of the shoe assembly should be horizontal and substantially parallel to the horizontal direction of unitary inward-outward movement of the brush 198, the margin sensor 202, and the side sensor 204. With this ideal arrangement, the roughing brush 198 roughs all the portions of the upper margin 210 a desired distance inwardly of the outer periphery of the upper margin. Should this line be inclined downwardly as it extends outwardly of the shoe assembly, the brush 198 will engage the upper margin further inwardly of its outer periphery than the desired distance. When the base 30 is retained in its prone position with the heel portion of the shoe bottom lying in a substantially horizontal plane, the forepart portion of the shoe assembly bottom lies in a plane that inclines upwardly in a direction extending from the toe end extremity of the shoe assembly bottom towards the heel end of the shoe assembly bottom. Therefore, with the forepart portion of the shoe assembly bottom lying in this inclined plane, the roughing brush 198 would engage the margin 210 a distance inwardly of its periphery greater than the desired distance when the toe portion of the upper margin is rotated 180° past the brush 198. It is for the purpose of preventing this undesired angularity between the direction of inward-outward movement of the side sensor 204 and the above referred to lines along the surface of the toe portion of the upper margin that the base 30 is in its inclined position with the forepart portion of the upper margin lying in a horizontal plane during the swinging of the toe portion of the upper margin past the margin sensor 202. Since the shoe assembly is in its prone position with the heel portion of the upper margin lying in a horizontal plane when the heel portion of the upper margin 210 is swung past the margin sensor 202, the direction of inward-outward movement of the side sensor 204 does not have the undesired angularity with respect to the above referred to lines of the heel portion of the upper margin during the 180° swinging of the heel portion of the upper margin past the margin sensor 202.

At the beginning of the machine cycle during the mounting of the shoe assembly on the machine, the length of the shoe assembly is determined by the motor 100 having the toe stop 138 into engagement with the toe end of the shoe assembly and this, by the mechanism shown in U.S. Patent Application Ser. No. 694,005, determines the extent of the first and second linear movements of the slide 18 thus ensuring that, regardless of the length of the shoe assembly, the entire upper margin 210 can be so moved past the brush 198 as to enable the desired roughing operation to be performed. The position of engagement of the toe stop 138 with the toe end of the shoe assembly also determines the positions of the actuating cams 174, 176, 178 and 180 thus ensuring that they respectively engage the valve actuating members 188, 190, 192 and 194 at the proper time regardless of the length of the shoe assembly. As stated above, the motor 172 acts to lock the foot 104 in the position it had assumed on the slide 18 pursuant to the engagement of the toe stop 138 with the toe end of the shoe assembly that had been caused by the actuation of the motor 100. During the swinging of the base 30 from its prone position to its inclined position, the follower 154 moves away from the nose 152 and the follower 154 returns into engagement with the nose 152 pursuant to the return of the base 30 from its inclined position to its prone position.

The actuating cams 176 and 180 located on the guide element 150 respectively coact with the valve actuating members 190 and 194 during the linear movements of the slide 18 to control the spacing of the brush 198 with respect to the peripheries of the concave side portions of the shoe assembly bottom to provide the functions described in U.S. Pat. No. 3,975,932.

In shoe assemblies wherein the bottom is arched and upwardly convex in planes that are transverse to the longitudinal heel-toe axis of the shoe assembly, the upper margin tapers downwardly to a great extent towards the side of the shoe assembly, particularly in the forepart area. As stated above, for the proper positioning of the roughing brush 198 on the upper margin, the lines extending from the area of engagement of the roughing brush 198 with each margin portion along the margin portion surface to the outer periphery of the margin portion and towards the area of engagement of the side sensor 204 with the corresponding portion of the side of the shoe assembly should be substantially parallel to the direction of unitary inward-outward movement of the side sensor 204 and the brush 198.

In addition, the side sensor 204 should bear against the side of the shoe assembly close to the shoe assembly bottom for the proper positioning of the brush 198 on the upper margin portions being roughed. In order to achieve these results, the shoe assembly is rocked laterally about its longitudinal axis (FIG. 8) in such directions as to place the upper margin portions being roughed in substantially horizontal planes as they are roughed by the brush 198.

In order to achieve this rocking of the shoe assembly, two control valves 250 and 251 are mounted to the base 14 and are placed outwardly of the turntable 16 on opposite sides of the turntable as seen in FIG. 6. The valves 250 and 251 are so arranged as to coact with a cam 252 that projects outwardly of the turntable 16 when the turntable is rotated.

Figures 12, 12A, 12B, 12C, 12D:
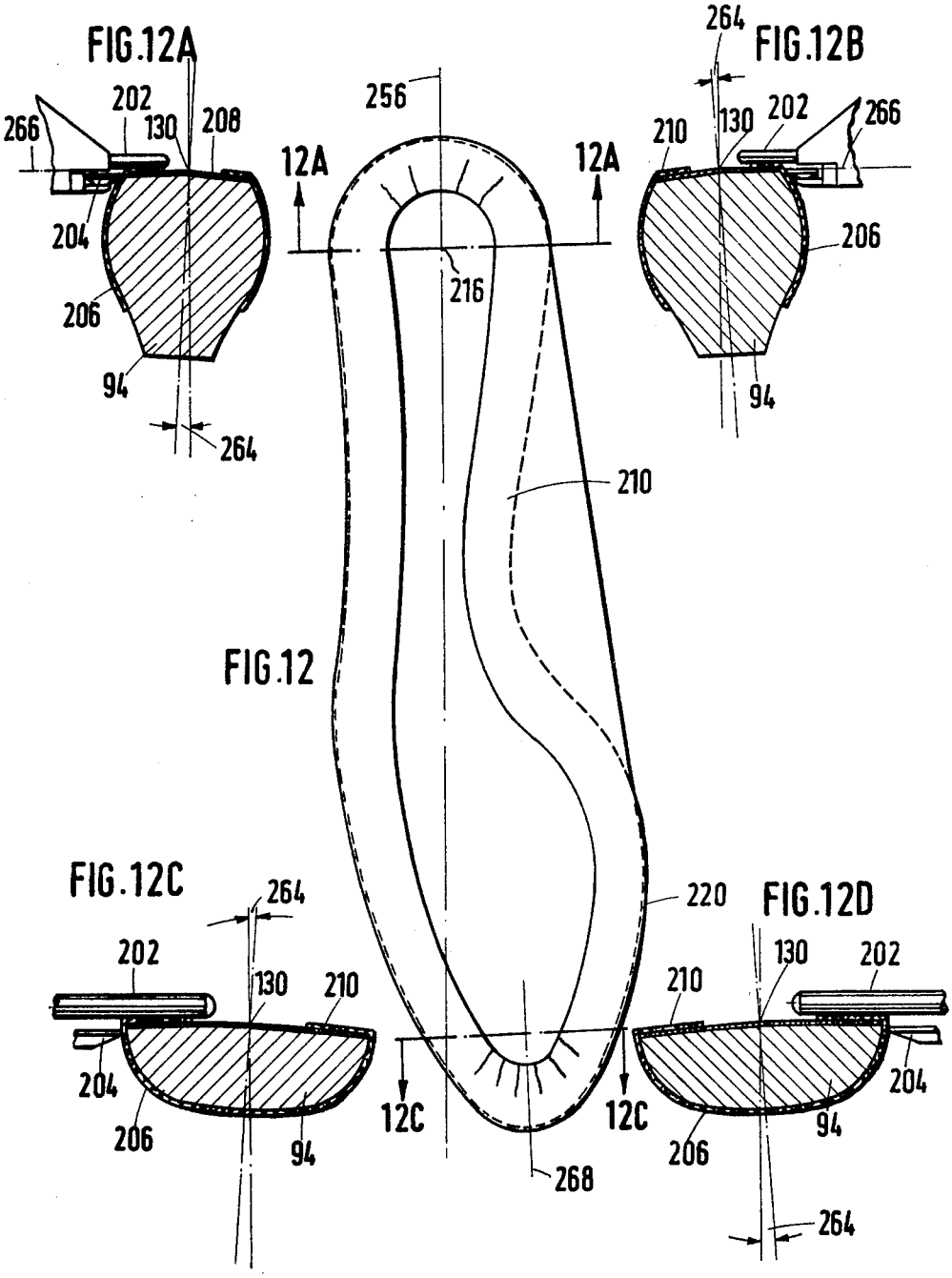
FIG. 12 is a top plan view of the shoe assembly bottom as it appears when mounted bottom-up in the machine.
FIGS. 12A and 12C are sections respectively taken along the lines 12A—12A and 12C—12C of FIG. 12 showing the shoe assembly support in its first position in accordance with the second species of the invention and showing the margin sensor and the height sensor in engagement with the shoe assembly.
FIGS. 12B and 12D are sections respectively similar to FIGS. 12A and 12C showing the shoe assembly as it appears when the shoe assembly support has been rocked to its second position in accordance with the second species of the invention.

The arrangement is such that, when the above-described rotational movement of the turntable occurs in order to rough the heel portion of the upper margin, the cam 252 engages and momentarily shifts the valve 251 when the brush 198 lies approximately at the longitudinal center line, indicated by number 256 in FIG. 12, of the heel portion of the shoe assembly. This momentary shifting of the a line valve 251 enables a pulse of pressurized air to pass from the source S through 258, the valve 251 and a pilot line 260 to the left side (FIG. 13) of a valve 262 to shift this valve. The shifting of the valve 262 enables pressurized air to pass therefrom to the motors 60 and 112 in such a manner as to respectively cause these motors to simultaneously tilt the last pin 90 and the toe rest 124 in the same direction to thereby tilt the shoe assembly about an angle 264, as seen in FIGS. 12B and 12D, so as to bring the portion of the upper margin being roughed into a substantially horizontal plane.

This laterally tilted position of the shoe assembly is maintained through the first heel-toe linear movement of the shoe assembly and the first part of the subsequent 180° rotation of the turntable until the roughing brush 198 reaches the area of the vertical plane passing through the center of curvature of the toe of the shoe assembly which is indicated in FIG. 12 by number 268 at which time the cam 252 engages and momentarily shifts the valve 250 to thereby send a pulse of pressurized air from the valve 250 through a pilot line 270 to the right side (FIG. 13) of the valve 262 to thereby shift this valve in the reverse direction from which it had previously been shifted by the pulse of pressurized air in the pilot line 260. This second shifting of the valve 262 enables pressurized air to pass therefrom through a line 272 to the motors 60 and 112 in such a manner as to cause them to tilt the shoe assembly about the same angle 264 from the vertical in the opposite direction from the vertical, as seen in FIGS. 12A and 12C to thereby raise the portions of the upper margins that are roughed during the remainder of the machine cycle into the horizontal plane 266.

The angle 264, through which the shoe assembly can be laterally tilted, may be regulated by means of adjustable stops that are not shown.

The degree to which the base 30 is swung along the arcuate tracks 26 from its prone position to its inclined position is regulated by adjustment of the threaded spindle 48 which coacts with the stop 46. In this manner, the extent of swinging of the shoe assembly may be adjusted in relation to the heel height of the shoe assembly.

As previously alluded to, the length of the shoe assembly is automatically taken into account when the shoe assembly is mounted on the machine in the following manner. The motor 100 causes the foot 104 to move towards the toe of the shoe assembly until the toe stop 138 engages said toe, after which the foot 104 is locked to the base 30. Since during this movement of the foot 104, pursuant to which the length of the shoe assembly is determined, the guide element 150 is concomitantly moved along with the cams 174, 176, 178 and 180 by means of the engagement of the follower 154 with the nose 152 and the cams are then firmly locked in place by the trunnion 164, an automatic adjustment of the train of motion of the upper margin 210 past the roughing brush 198 takes place. At the end of the machine cycle, when the shoe assembly is removed from the machine, the motor 100 is so actuated as to move the foot 104 away from the post 52. At the same time as the foot 104 is moved away from the post 52, the motor 172 is vented so that the return spring 170 causes the locking trunnion 164 to be disengaged from the guide bar 156. In addition, at the same time as the foot 104 is moved away from the post 52, pressurized air again enters the motor 162 to cause the guide bar 156 to move the guide element 150 and the cams 174, 176, 178 and 180 back to their idle positions. Because of the aforementioned coupling between the foot 104 and the guide element 150 formed by the nose 152 and the follower 154, the base 30 can freely swing between its prone and inclined positions without being interfered with by the guide element 150.

There follows a recapitulation of the machine parts and the mode of operation of the machine that are pertinent of this invention.

The machine is intended to rough the upper margin 210 of the shoe assembly, the shoe assembly being comprised of the last 94 having the insole 208 located on its bottom and the upper 206 mounted thereon with the upper margin 210 lying against and being secured to the bottom of the insole. The members 72, 90 form a first shoe assembly supporting element and the member 124 forms a second shoe assembly supporting element, the two shoe assembly supporting elements collectively forming a support for supporting the shoe assembly bottom-up. The fork tines 202 form a margin sensor engageable with the upper margin. The feeler roll 204, located below the margin sensor 202, forms a side sensor that is engageable with the side of the shoe assembly. The roughing tool 198 is located inwardly of the side sensor 204 and proximate to the margin sensor 202 and is engageable with the upper margin to rough the upper margin. Both sensors 202 and 204 and the roughing tool 198 are mounted for unitary heightwise movement and for unitary inward-outward movement in a particular direction by means shown in U.S. Patent Application Ser. No. 694,005. Means, shown in U.S. Patent Application Ser. No. 694,005 so move the support as to move succeeding upper margin portions past the margin sensor 202 and as to move corresponding succeeding side portions of the shoe assembly past the side sensor 204 to thereby move the margin portions past the roughing tool 198. As disclosed in U.S. Patent Application Ser. No. 694,005, the machine incorporates means enabling the margin sensor 202 to move heightwise and follow the contour of the upper margin portions to thereby enable the roughing tool 198 to move heightwise accordingly and means enabling the side sensor 204 to move inwardly-outwardly in said particular direction and follow the contour of the shoe assembly side portions to thereby enable the roughing tool 198 to move inwardly-outwardly accordingly.

Figure 4:
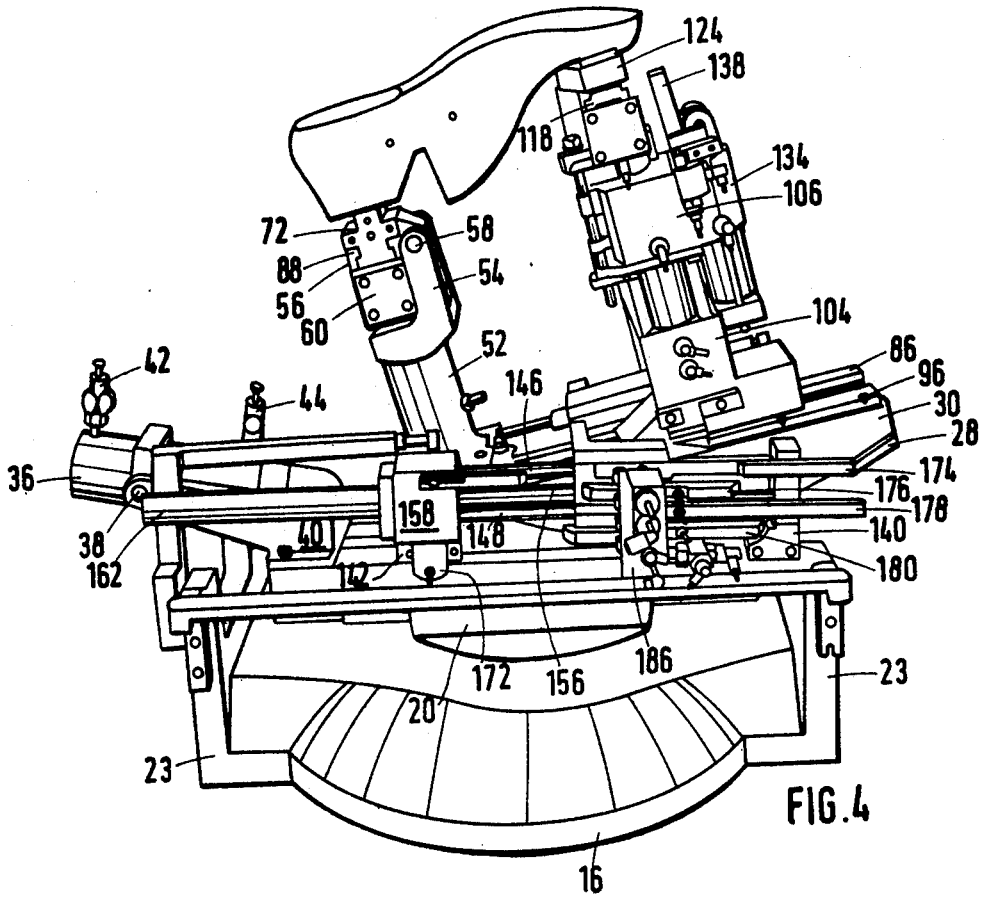
FIGS. 4 and 5 are views similar to FIG. 3 showing the shoe assembly rocked to its second position in accordance with the first species of the invention taken from opposite sides of the mount section.

In accordance with the first species of the invention, the arcuate tracks 26 form means mounting the support for rocking movement between a first position, shown in FIG. 3, and a second position, shown in FIG. 4. Pressurized air entering the motor 36 through the line 228 acts as means for initially retaining the support in its first position. The engagement of the actuating cam 178 with the valve actuating member 192 acts as means, effective during the support movement, to rock the support from its first position to its second position.

In accordance with the second species of the invention, the guide surface 72 and the guide element 122 form means mounting the support for rocking movement between the positions shown in FIGS. 12A and 12C and in FIGS. 12B and 12D, one of these positions being a first position and the other of these positions being a second position. Pressurized air entering the motors 60 and 112 through either the ports 84 and 128 or through the ports 86 and 126 acts as means for initially retaining the support in its first position. The engagement of the cam 252 with one of the control valves 250, 251 acts as means, effective during the support movement, to rock the support from its first position to its second position.

In both species of the invention, the rocking of the support from its first position to its second position ensures that, regardless of any changes in the planes in which succeeding margin portions lie or any changes in the contours of the succeeding margin portions, a line extending from the area of engagement of the roughing tool 198 with each margin portion along the surface of the margin portion to the outer periphery of the margin portion towards the area of the engagement of the side sensor 204 with the corresponding portion of the side of the shoe assembly will be substantially parallel to said particular direction.

Reverting to the first species of the invention, the heel and forepart portions of the shoe assembly bottom lie in intersecting planes. The means for so moving the support as to move the margin portions past the roughing tool 198 comprises, as shown in U.S. Patent Application Ser. No. 694,005, means for so rotating the support 180 degrees about a vertical axis in a particular rotational direction as to rotate a first end (herein disclosed as the heel end) of the upper margin 210 past the roughing tool 198, means for thereafter so horizontally moving the support linearly as to move a side of the upper margin 210 past the roughing tool 198, and means for thereafter so rotating the support 180 degrees in said particular rotational direction about the vertical axis as to rotate the second end (herein disclosed as the toe end) of the upper margin 210 past the roughing tool 198. The arcuate tracks 26, which mount the support for rocking movement, are so constructed as to rock the support about the horizontal axis 230 that is transverse to the direction of linear movement of the support. The engagement of the actuating cam 178 with the valve actuating member 192 acts as triggering means actuable pursuant to the linear movement of the support for effecting the rocking of the support. The end of the shoe assembly bottom corresponding to the first end of the upper margin lies in a substantially horizontal plane when the support is in its first position and the end of the shoe assembly corresponding to the second end of the upper margin lies in a substantially horizontal plane when the support is in its second position.

The support is moved past the roughing tool 198 in the manner described above by mechanism that includes the turntable 16 mounted for rotation about the vertical axis and the slide 18 mounted to the turntable for linear horizontal movement between two end positions. The shoe assembly support is mounted to the slide by means of the post 52 and the foot 104. By the mechanism disclosed in Patent Application Ser. No. 694,005, the slide 18 is initially located at one of its end positions, the turntable 16 is thereafter rotated 180° in the particular rotational direction to effect the first mentioned rotation of the support, the slide is thereafter linearly moved from the first end position to the other end position to effect the horizontal linear movement of the support, and the turntable 16 is thereafter rotated 180° in the particular rotational direction to effect the second mentioned rotation of the support. The support is mounted for rocking movement by way of the base 30 mounted to the slide 18 for rocking movement with respect to the slide about the horizontal axis 230 between the prone position shown in FIG. 3 in which it is initially located and the inclined position shown in FIG. 4, and the support is mounted to the base 30 by means of the post 52 and the foot 104 to thereby mount the support to the slide 18. The means for rocking the support and the triggering means comprise the actuating cam 178, which acts as an actuating member, mounted to the slide 18 for linear movement therewith, the valve actuating member 192, which acts as a control member, mounted to the turntable 16 in intersecting relationship with the actuating member 178, and means that includes the motor 36 responsive to the intersection of the actuating member 178 with the control member 192 for imparting movement of the base 30 from its prone position to its inclined position. The motor 36 constitutes a yieldable drive means that is mounted to the slide 18 and is connected to the base 30.

The spindle 48 constitutes a first stop member adjustably mounted to the slide 18 and the stop 46 constitutes a second stop member mounted to the base 30 in intersecting relationship with the first stop member 48. The intersection of the stop members during the movement of the base 30 from its prone position determines the inclined position of the base.

The position of engagement of the toe stop 138 with the toe end of the shoe assembly when the toe stop 138 is moved towards the toe end of the shoe assembly by the motor 100 together with the mechanism shown in U.S. Patent Application Ser. No. 694,005 constitutes means that adjust the extent of the linear movement of the shoe assembly support an amount that is proportional to the length of the shoe assembly. The positioning of the actuating cam 178 a variable distance from the valve actuating member 192, prior to the linear movement of the shoe assembly support, that is proportional to the length of the shoe assembly provides such a construction of the triggering means as to cause it to be actuated after the shoe assembly support has moved linearly an amount that is proportional to the length of the shoe assembly.

The means mounting the shoe assembly support to the slide 18 comprises: the post 52 mounted to the slide 18; the shoe assembly supporting element, constituted by the members 72, 90 forming part of the shoe assembly support, mounted to the post; the foot 104 mounted to the slide 18 for movement towards and away from the post 52; the shoe assembly supporting element, constituted by the toe pad 124, mounted to the foot; and means, comprised of the motor 100, for moving the foot towards the post an amount such as to space the foot from the post at a working position, determined by the engagement of the toe stop 138 with the toe end of the shoe assembly, whose distance from the post is proportional to the length of the shoe assembly. An arrangement for causing the extent of the linear movement of the slide to be proportional to the spacing of the foot from the post, as disclosed in U.S. Patent Application Ser. No. 694,005, is incorporated in the machine. The means mounting the post 52 and the foot 104 to the slide 18 comprises means rigidly mounting the post 52 to the base 30 and means mounting the foot 104 to the base 30 for movement towards and away from the post 52. The machine also incorporates: means, constituted by the motor 162, for initially maintaining the actuating member 178 in an idle position relatively remote from the post 52; cooperative engaging members, constituted by the follower 154 and the nose 152, respectively mounted to foot 104 and the actuating member 178, operable to move the actuating member 178 towards the post 52 pursuant to the movement of the foot 104 towards the post 52; and means, constituted by the cooperating teeth on the trunnion 164 and the guide bar 156, for locking the actuating member 178 to the slide 18 when the foot 104 has arrived at its working position. The engaging members 152, 154 are so constructed and arranged that the engaging member 154 mounted to the foot 104 may move away from the engaging member 152 mounted to the actuating member 178 pursuant to the movement of the base 30 from its prone position to its inclined position. The means locking the actuating member 178 to the slide 18 comprises: a first brake element, constituted by the guide bar 156, mounted to the actuating member for movement therewith; a second brake element, constituted by the locking trunnion 164, mounted to the slide 18 for movement towards and away from the first brake element 156; and means, constituted by the motor 172, for causing the second brake element 164 to engage the first brake element 156 when the foot 104 has arrived at its working position.

Reverting to the second species of the invention, the means for so moving the support as to move the margin portions past the roughing tool 198 comprises, as shown in U.S. Patent Application Serial No. 694,005, means for so horizontally moving the support linearly in a first direction as to move a first side of the upper margin past the roughing tool 198, means for thereafter so rotating the support 180° about a vertical axis as to rotate an end of the upper margin (herein disclosed as the toe end) past the roughing tool 198, and means for thereafter so horizontally moving the support linearly in a second direction opposite to the first direction as to move the second side of the upper margin past the roughing tool 198. The means mounting the support for rocking movement is so constituted as to enable the support to be rocked through an upwardly concave arc whose center of curvature lies on the horizontal axis 82 or 130 that is parallel to the directions of the linear movements. The first position of the shoe assembly, shown in FIGS. 12A and 12C, is such that the support is tilted about said horizontal axis 82 or 130 on one side of the vertical axis of the support and the second position of the shoe assembly, shown in FIGS. 12B and 12D, is such that the support is tilted about said horizontal axis 82 or 130 on the other side of the vertical axis of the support. The means for rocking the support from its first position to its second position is comprised of triggering means, that include the cam 252 and the valve 250, that is actuable pursuant to the support rotation to effect the rocking.

Similarly to the first species of the invention, the means for so moving the support as to move the margin portions past the roughing tool comprises: the turntable 16 mounted for rotation about the vertical axis; the slide 18 mounted to the turntable 16 for linear horizontal movement between two end positions; means comprised of the post 52 and the foot 104 mounting the support to the slide 18; and means shown in U.S. Patent Application Ser. No. 694,005 for initially locating the slide at a first one of the end portions, for thereafter moving the slide 18 from its first end position to its second end position to effect the horizontal linear movement of the support in its first direction, for thereafter rotating the turntable 180 degrees about the vertical axis to effect the support rotation, and for thereafter linearly moving the slide 18 horizontally from its second end position to its first end position to effect the horizontal linear movement of the support in its second direction. The triggering means comprises: the cam 252 that forms an actuating member mounted to the turntable 16; the valve 250 that forms a control member so located as to be intersected by the actuating member 252 during the turntable rotation; and means, comprised of the pilot line 260, the valve 262, and pressurized air passing from the valve 262 to the motors 60 and 112, that are responsive to the intersection of the actuating member 252 with the control member 251 for effecting the rocking of the support from its first position to its second position.

The machine includes the post 52 and the foot 104 mounted to the slide 18. The support comprises a first shoe assembly supporting element, formed of the members 72 and 90, mounted to the post 52 and a second shoe assembly supporting element, formed of the toe pad 124, mounted to the foot 104. The means mounting the support for rocking movement comprises means, formed of the guide surface 74, mounting the first shoe assembly supporting element 72, 90 to the post 52 for movement through the upwardly concave arc and means, formed of the guide element 122, mounting the second shoe assembly supporting element 124 to the foot 104 for movement through the upwardly concave arc. The means for rocking the support comprises: first powered means, comprised of the motor 60, mounted to the post 52 and so connected to the first shoe assembly supporting element 72, 90 as to move the first shoe supporting element 72, 90 through its upwardly concave arc in response to actuation of the first powered means 60; second powered means, comprised of the motor 112, mounted to the foot 104 and so connected to the second shoe assembly supporting element 124 as to move the second shoe assembly supporting element 124 through its arc in response to actuation of the second powered means; and means, comprised of the pilot line 260, the valve 262, and pressurized air passing from the valve 262 to the motors 60 and 112, responsive to the intersection of the actuating member 252 with the control member 251, to actuate the first powered means 60 and the second powered means 112.

Terms such as "vertical" and "horizontal" are not intended to be literally construed but are intended to define relative relationships. Therefore, constructions that have such relative relationships are deemed to come within the combinations defined in the appended claims if they otherwise have the claimed combinations regardless of whether such constructions literally have such relationships.

I claim:

1. A machine for roughing the margin of an upper of a shoe assembly, said shoe assembly comprising a last having an insole located on its bottom and the upper mounted thereon and being secured to the bottom of the insole, the heel and forepart portions of the shoe assembly lying in intersecting planes, comprising: a shoe assembly support for supporting the shoe assembly bottom-up; a margin sensor engageable with the upper margin; a side sensor, located below the margin sensor, engageable with the side of the shoe assembly; a roughing tool located above the support, inwardly of the side sensor, and proximate to the margin sensor and engageable with the upper margin to rough the upper margin; means mounting both sensors and the roughing tool for unitary heightwise movement; means mounting both sensors and the roughing tool for unitary inward-outward movement in a particular direction; support moving means for so moving the support as to move succeeding upper margin portions past the margin sensor and as to move corresponding succeeding side portions of the shoe assembly past the side sensor to thereby move said margin portions past the roughing tool, said support moving means comprising means for so rotating the support 180 degrees about a vertical axis in a particular rotational direction as to rotate a first end of the upper margin past the roughing tool, means for thereafter so horizontally moving the support linearly as to move a side of the upper margin past the roughing tool, and means for thereafter so rotating the support 180 degrees about said vertical axis in said particular direction as to rotate the second end of the upper margin past the roughing tool; means enabling the margin sensor to move heightwise and follow the contour of said upper margin portions to thereby enable the roughing tool to move heightwise accordingly; and means enabling the side sensor to move inwardly-outwardly in said particular direction and follow the contour of said side portions to thereby enable the roughing tool to move inwardly-outwardly accordingly; the machine having the improvement comprising: means mounting the support for rocking movement between a first position and a second position about a horizontal axis that is transverse to the direction of said linear movement; means for initially retaining the support in said first position wherein the end of the shoe assembly bottom corresponding to said first end of the upper margin lies in a substantially horizontal plane; and triggering means actuable pursuant to said linear movement for rocking the support from its first position to its second position wherein the end of the shoe assembly bottom corresponding to said second end of the upper margin lies in a substantially horizontal plane; whereby a line extending from the area of engagement of the roughing tool with each portion of the ends of the upper margin along the surface of the engaged margin to the outer periphery of the margin portion and towards the area of engagement of the side sensor with the corresponding portion of the side of the shoe assembly will be substantially parallel to said particular direction.

2. The machine of claim 1 wherein the means for so moving the support as to move said margin portions past the roughing tool comprises: a turntable mounted for rotation about said vertical axis; a slide mounted to the turntable for linear horizontal movement between two end positions; means mounting the support to the slide; means initially locating the slide at a first one of said end positions; means for thereafter rotating the turntable 180 degrees in said particular rotational direction to effect said first mentioned rotation of the support; means for thereafter linearly moving the slide from said first one of said end positions to the other end position to effect said horizontal linear movement of the support; and means for thereafter rotating the turntable 180 degrees in said particular rotational direction to effect said second mentioned rotation of the support; the machine having the improvement wherein said means mounting the support for rocking movement comprises: a base mounted to the slide for rocking movement with respect to the slide about said horizontal axis between a prone position in which it is initially located and an inclined position; and means mounting the support to the base; and the machine having the further improvement wherein said means for rocking the support and said triggering means comprise: an actuating member mounted to the slide for linear movement therewith; a control member mounted to the turntable in intersecting relationship with the actuating member; and means responsive to the intersection of the actuating member with the control member for imparting movement of the base from its prone position to its inclined position.

3. The machine of claim 2 having the improvement wherein the means for imparting said movement of the base comprises: yieldable drive means mounted to the slide and connected to the base.

4. The machine of claim 3 having the improvement comprising: a first stop member adjustably mounted to the slide; and a second stop member mounted to the base in intersecting relationship with the first stop member; the intersection of the stop members during said movement of the base determining the inclined position of the base.

5. The machine of claim 1 further comprising: means adjusting the extent of the linear movement of the support an amount that is proportional to the length of the shoe assembly, the machine having the improvement wherein the triggering means is so constructed as to be actuated after the linear movement of the support an amount that is proportional to the length of the shoe assembly.

6. The machine of claim 2 wherein said means mounting the shoe assembly support to the slide comprises: a post rigidly mounted to the slide; a shoe assembly supporting element, forming part of said shoe assembly support, mounted to the post, a foot mounted to the slide for movement towards and away from the post; a shoe assembly supporting element, forming part of said shoe assembly support, mounted to the foot; and means for moving the foot towards the post an amount such as to space the foot from the post at a working position whose distance from the post is proportional to the length of the shoe assembly; the machine further comprising: means for causing the extent of the linear movement of the slide to be proportional to the spacing of the foot from the post; the machine having the improvement wherein said means mounting the post and the foot to the slide comprises: means rigidly mounting the post to the base; and means mounting the foot to the base for said movement towards and away from the post; and the machine having the further improvement comprising: means initially maintaining the actuating member in an idle position relatively remote from the post; cooperative engaging members mounted to the foot and the actuating member operable to move the actuating member towards the post pursuant to the movement of the foot towards the post; and means locking the actuating member to the slide when the foot has arrived at its working position; said engaging members being so constructed and arranged that the engaging member mounted to the foot may move away from the engaging member mounted to the actuating member pursuant to the movement of the base from its prone position to its inclined position.

7. The machine of claim 6 having the improvement wherein said means locking the actuating member to the slide comprises: a first brake element mounted to the actuating member for movement therewith; a second brake element mounted to the slide for movement towards and away from the first brake element; and means for causing the second brake element to engage the first brake element when the foot has arrived at its working position.

* * * * *

UNITED STATES PATENT AND TRADEMARK OFFICE

CERTIFICATE OF CORRECTION

PATENT NO. : 4090378

DATED : May 23, 1978

INVENTOR(S) : Gerald Sommer

It is certified that error appears in the above-identified patent and that said Letters Patent are hereby corrected as shown below:

The number of the first reference on the cover sheet under "U.S. PATENT DOCUMENTS" should be --3,163,031-- instead of "2,163,031" and the name of the patentee of this reference should be --Kestell-- instead of "Kostell".

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*